US006498767B2

(12) United States Patent
Carreiro

(10) Patent No.: US 6,498,767 B2
(45) Date of Patent: Dec. 24, 2002

(54) CRUISE MISSILE DEPLOYED SONAR BUOY

(75) Inventor: Paul J. Carreiro, Swansea, MA (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 09/832,114

(22) Filed: Apr. 11, 2001

(65) Prior Publication Data

US 2002/0149996 A1 Oct. 17, 2002

(51) Int. Cl.[7] ..... B64D 1/02
(52) U.S. Cl. ..... 367/4; 244/137.4
(58) Field of Search ..... 367/3, 4, 5, 131, 367/128; 342/357.06; 244/137.3, 120; 441/30

(56) References Cited

U.S. PATENT DOCUMENTS 4,622,557 A * 11/1986 Westerfield ..... 342/357
6,056,237 A * 5/2000 Woodland ..... 244/3.15
6,082,675 A * 7/2000 Woodall, Jr. et al. .... 244/137.4

* cited by examiner

*Primary Examiner*—Daniel T. Pihulic
(74) *Attorney, Agent, or Firm*—Michael J. McGowan; James M. Kasischke; Michael F. Oglo

(57) ABSTRACT

A sonar buoy adapted to be deployed by a cruise missile. This sonar buoy includes a flotation device for keeping a portion of the buoy afloat, a hydrophone, a transmitter for communicating contact and position information and releasable means for attaching the sonar buoy to the cruise missile. By means of this device, a means of monitoring littoral and other waters for enemy submarines and other threats is provided with a low degree of risk to friendly forces. A system for deploying this sonar buoy in a sonar buoy field is also disclosed.

10 Claims, 6 Drawing Sheets

CRUISE MISSILE DEPLOYED SONAR BUOY

STATEMENT OF GOVERNMENT INTEREST

The invention described herein may be manufactured and used by or for the Government of the United States of America for governmental purposes without the payment of any royalties thereon or therefor.

BACKGROUND OF THE INVENTION (1) Field of the Invention

The present invention relates to acoustic wave systems and devices, and more particularly to sonobuoys with component activating or deployment means.

(2) Brief Description of the Prior Art

Expanding mission requirements caused by the increased frequency of regional conflicts and state-sponsored terrorism, have forced fast attack submarines into littoral operations. Submarines are well suited for this type of mission, allowing on-station, forward deployment, without the vulnerability, or force telegraphing of a surface ship and the associated political and tactical ramifications. Whether alone, or acting in conjunction with a battle group, the submarine will increasingly be called on to patrol and prosecute hostile contacts in this challenging environment as well as deliver precision missile strikes on inland targets.

Hostile submarines are a serious threat to friendly submarines, as well as to friendly surface ships. One such danger comprises diesel-electric type submarines, commonly known as diesel boats. While relatively cumbersome for extended, deep-water operations, diesel boats are well suited for coastal defense in the littoral regions. Relatively small, inexpensive and quiet (when operating on battery power), diesel boats can lie in wait for an approaching battle group, or patrol quietly just off the shore in search of submarines and surface craft.

While fast attack submarines possess many operational advantages, there are still considerable risks associated with entering shallow or "brown" water to search for enemy submarines. A nuclear-powered fast attack submarine would prove a priceless propaganda trophy for any hostile country. Many of the same risks would attend operations by surface ships in such waters.

Another submarine hunting method is using an Anti-Submarine Warfare (ASW) helicopter launched from a surface ship at standoff distance. This method, however, also entails considerable risk due to the amount of time the helicopter must spend hovering, while dipping sonar to locate the hostile submarine, leaving it seriously vulnerable to fire from shore or from small craft.

The prior art also discloses the use of buoys or other discrete deployable devices for housing a sonar apparatus or other sensors that may be used to monitor an area for hostile submarine threats. U.S. Pat. No. 4,186,374 to Ouellette, for example, discloses a transducer housing for an air dropped sonar transducer including a smooth cylindrical case for stowage on board an aircraft. The case is formed with a separation device, which permits ejection of the transducer from the case upon impact with the surface of the ocean, the device being formed of tabs on the case and chamfers on a cover plate of the case. The impact of the water on the cover plate is directed by the chamfers against the tabs to spread them apart thereby releasing the cover plate and the transducer. Pins on the cover plate project through apertures in the tabs and press against the side of the apertures with a preset force to essentially lock the tabs to the plate until the preset force is overcome by the water impact.

U.S. Pat. No. 5,691,957 to Spiesberger discloses an acoustic tomography telemetry system and method that allows spatially averaged ocean temperatures to be measured in real-time. This system includes autonomous acoustic sources mounted on subsurface mooring and receivers that are either suspended from drifting surface buoys or cabled to shore. The telemetry method largely eliminates, in real-time, corruption of acoustic travel times due to wander of the source's mooring by shifting the start times of tomographic transmissions. Corrections to source wander are obtained without expending battery energy over and above that used in conventional tomography experiments. Standard techniques are used to correct clock errors at the source in real-time.

U.S. Pat. No. 5,973,994 to Woodall discloses a sonobuoy device for tracking and targeting submarines. The sonobuoy device consists of a sonobuoy having aft and forward sections interconnected with each other, fin means mounted on the aft section for flight stabilization of the device during travel above water from the platform, separation means responsive to impact of the device with the water upon completion of the travel thereof for separating the sections of the device from each other, payload means within the forward section of the device for listening for an acoustical signal in response to submergence thereof within the water following the separation of the sections of the device, flotation means mounted within the device and inflated in response to the impact with the water for anchoring the payload means and tethering means connecting the flotation means to the payload means for limiting the submergence thereof while anchored by the flotation means to a predetermined depth at which the payload means receives an acoustical signal. An apparatus comprised of a device with a launching system and a method for deploying the device also is disclosed.

A further improved means for efficiently and cost effectively deploying sonar buoys with a low degree of risk to friendly forces is still needed.

SUMMARY OF THE INVENTION

It is an object of the present invention to provide a device and method for efficiently and cost effectively monitoring littoral and other waters for enemy submarines and other threats with a low degree of risk to friendly forces.

It is a further object of the present invention to provide a means for a submarine-launched cruise missile to lay a wide-area field of sonar buoys from a standoff distance.

This and other objects are accomplished by the apparatus of the present invention, which is a sonar buoy adapted to be deployed by a cruise missile. This sonar buoy includes a flotation device for keeping a portion of the buoy afloat, a hydrophone, a transmitter for communicating contact and position information and a releasable means for attaching the sonar buoy to the cruise missile. By means of this device, a means of monitoring littoral and other waters for enemy submarines and other threats is provided with a low degree of risk to friendly forces.

Preferably, this sonar buoy may be deployed by a submarine-launched Tomahawk UGM 109D cruise missile outfitted with sonar buoys. Originally designed to deliver small sub-munitions to multiple targets, the UGM 109D features four payload modules, each holding six packs of sub-munitions. The Tomahawk sonar buoy device replaces each pack with a payload shell containing a sonar buoy.

This apparatus allows a submarine to lay a wide area field of sonar buoys from a standoff distance, allowing anti-submarine warfare (ASW) forces to pinpoint and track hostile contacts from a safe range before attacking.

BRIEF DESCRIPTION OF THE DRAWINGS

Other objects, features and advantages of the present invention will become apparent upon reference to the following description of the preferred embodiments and to the drawing, wherein corresponding reference characters indicate corresponding parts in the drawing and wherein.

DESCRIPTION OF THE PREFERRED EMBODIMENT

Figure 1:
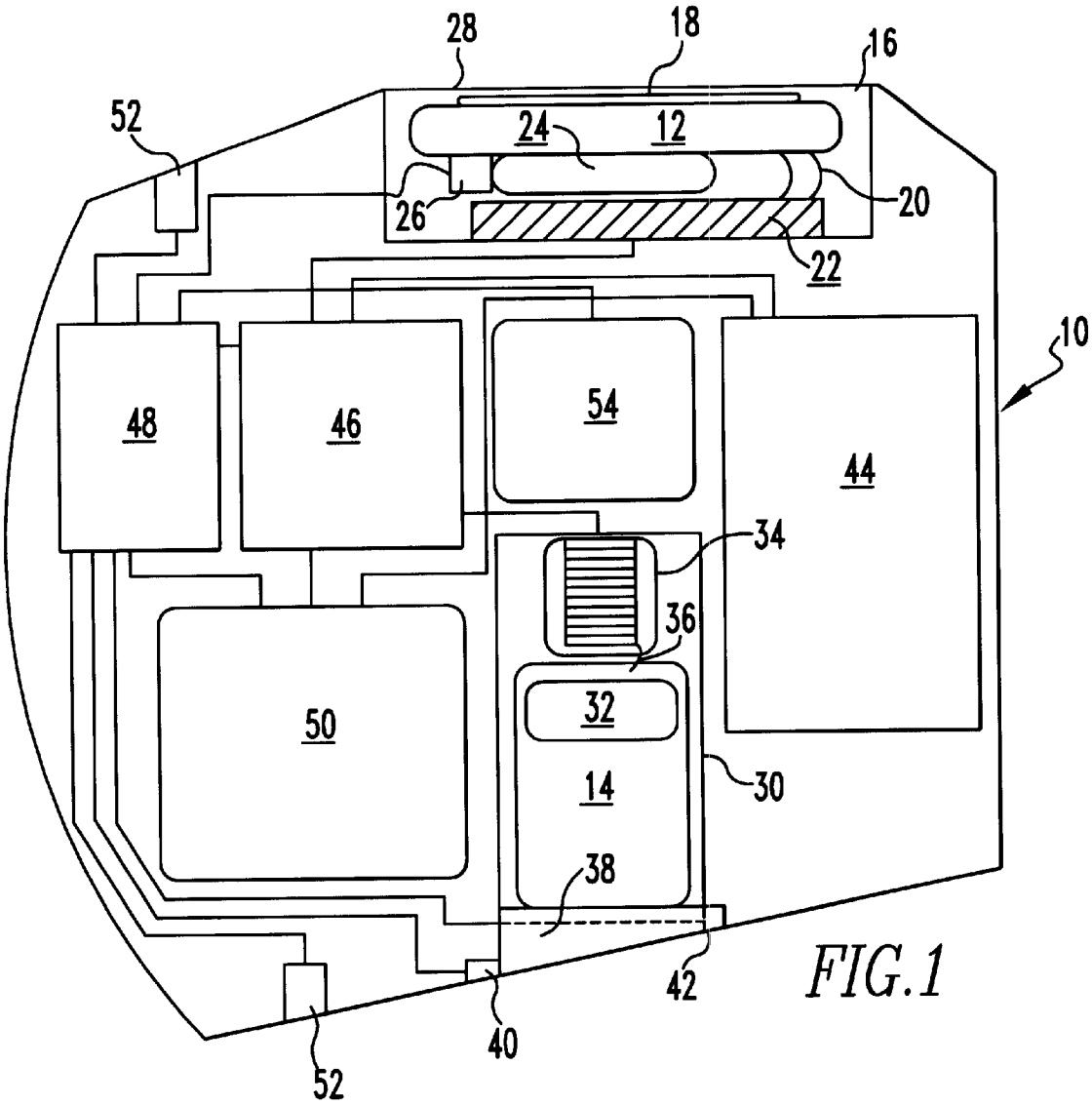
FIG. 1 is a vertical cross sectional view of a sonar buoy representing a preferred embodiment of the device of the present invention.

Referring to FIG. 1, a complete sonar buoy prior to deployment is shown. The sonar buoy shell 10 has the same external dimensions as the sub-munitions pack it replaces. The shell provides impact and underwater protection to the internal components and acts as a platform for the inflatable float 12 and the hydrophone 14. The float well 16 contains the inflatable float 12, antenna 18, lanyard/antenna lead 20, lanyard bundle 22, $CO_2$ canister 24, and pyro-activated inflation valve 26. The upper section of the lanyard/antenna lead 20 is bonded to the inflatable float 12 and the base of the antenna 18 is bonded to the top end of the lanyard/antenna lead 20. A tear-through cover 28 seals the float well 16. A hydrophone well 30 contains the hydrophone 14, weight 32, hydrophone wire spool 34 and hydrophone wire 36. A perforated hydrophone well cover 38 holds the hydrophone 14 in place prior to deployment. Two pyro-activated latches 40 and 42 secure the cover to the sonar buoy shell 10. A global positioning system (GPS) 44 receives satellite information from a transceiver 46, calculates the buoy's position and sends the position information back to the transceiver 46. The transceiver 46 transmits and receives via the antenna 18 and lanyard/antenna lead 20. A control unit 48 provides internal buoy control. A battery 50 provides power for the buoy. Saltwater sensors 52 detect submergence in saltwater; however, other sensors such as accelerometers can be used to detect impact. A scuttle device 54 contains an explosive charge. On command from the control unit 48, the scuttle device 54 explodes, severing the sonar buoy shell 10 from the lanyard/antenna lead 20 and the hydrophone wire 36 and destroying the buoy.

Figure 2:
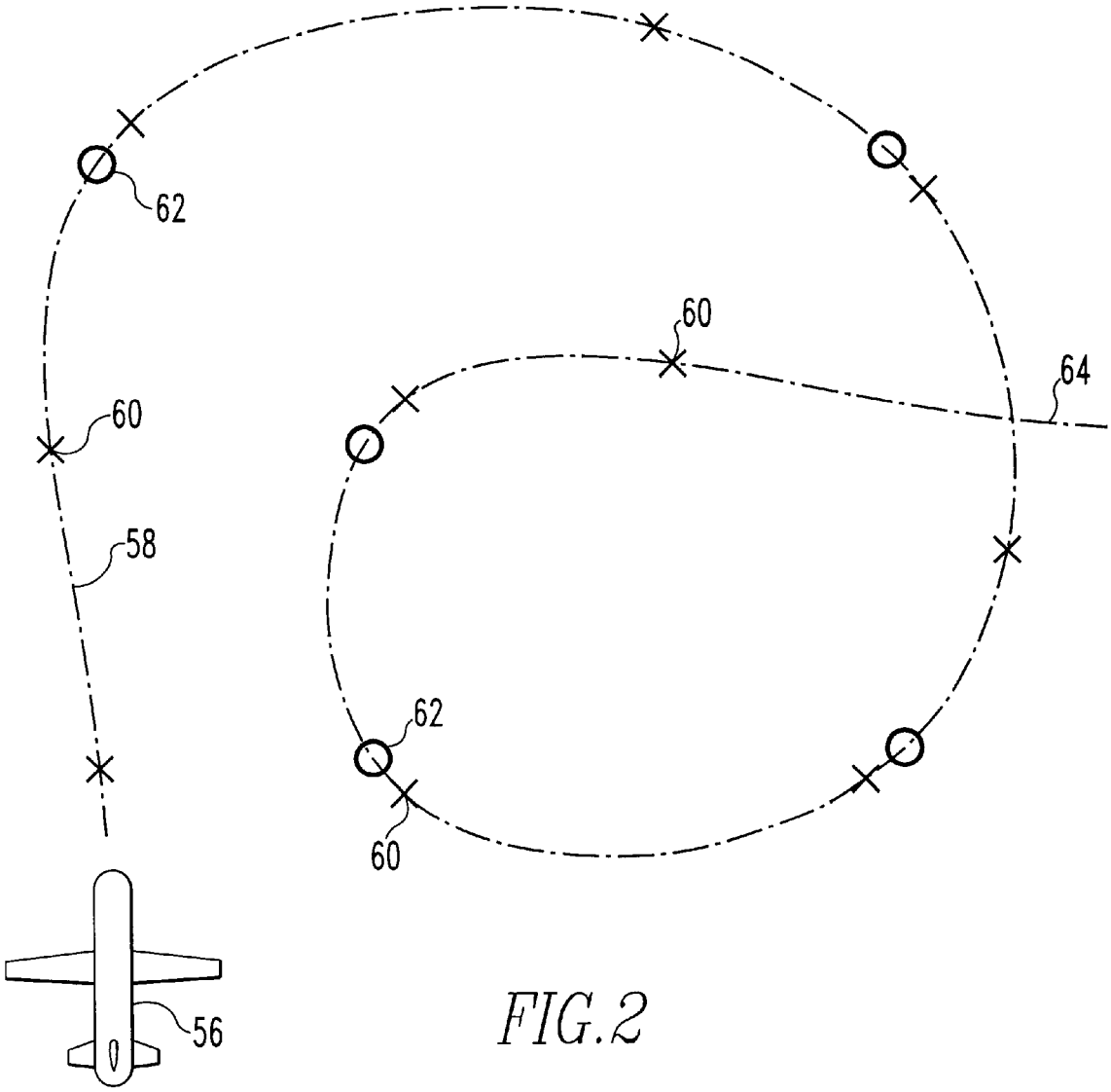
FIG. 2 is a plan schematic illustration showing a preferred method of deploying a plurality of sonar buoys as shown in FIG. 1 over an operating area.

When a search is ordered, a cruise missile is programed with waypoints for a circuitous flight path over the desired area. The submarine launches the cruise missile outfitted with the sonar buoys. FIG. 2 shows an example mission profile. The cruise missile ejects the sonar buoys at timed intervals between waypoints.

Referring to FIG. 2, a cruise missile 56 is launched on a flight path 58. Flight path 58 can be structured using navigational waypoints 60. Waypoints 60 can be programmed in the missile 56 and indicated by inertial coordinates, global positioning system coordinates, or the like. Sonar buoys are sequentially deployed at predetermined locations 62 along flight path 58. Locations 62 can be an array or in some other configuration dictated by the tactical circumstances. The actual deployment location 62 can be sent by using the GPS receiver embodied in each buoy. Upon completing buoy deployment, missile 56 enters a final flight path 64 and prepares for self-destruction. During the final leg 64, the missile flies clear of the buoy field and friendly contacts and climbs high into the air then dives sharply into the ocean and sinks. Other tactical circumstances may require other self-destruction procedures.

When the sonar buoy shell 10 hits the ocean, it sinks. Saltwater touching one or both of the saltwater sensors as at sensor 52 activates the control unit 48. The control unit 48 fires the inflation valve 26, filling the inflatable float 12 with gas from the $CO_2$ canister. As the inflatable float 12 fills, the tear through cover 28 yields and the float drifts free of the float well 16, trailing the lanyard/antenna lead 20 behind it. The inflatable float 12 rises, while the sonar buoy shell 10 sinks, paying out lanyard/antenna lead 20 from the lanyard bundle 22.

Figure 3A:
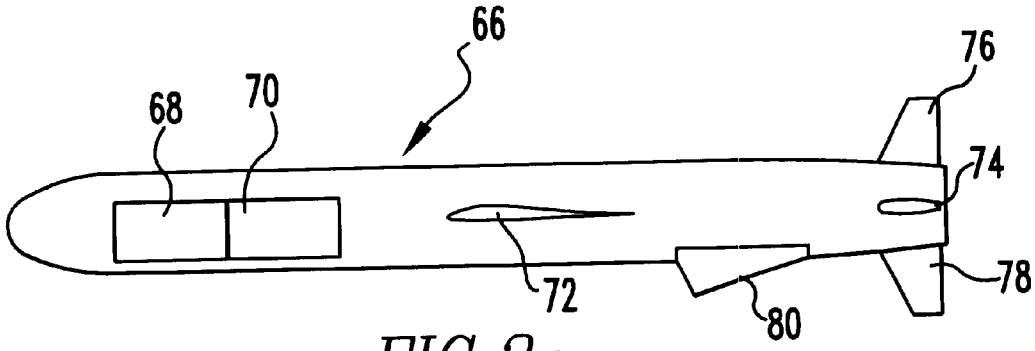
FIG. 3*a* is a side elevational view of a cruise missile, which may be used to deploy the sonar buoy shown in FIG. 1.

Referring to FIG. 3*a,* a Tomahawk cruise missile UGM-109D 66 is shown on which there are two payload modules 68 and 70 on each of its lateral sides for a total of four payload modules. As is conventional, the cruise missile 66 also includes a pair of wings 72, a pair of aft horizontal stabilizers 74, a pair of vertical stabilizers 76 and 78 and air intake 80 and a jet engine. Other equivalent types of cruise missiles such as those propelled with rocket motors can be employed with the apparatus and method of this invention. As is conventional, the cruise missile has a guidance system (not shown) capable of directing the missile on a substantially non-ballistic, circuitous flight path.

Figure 3B:
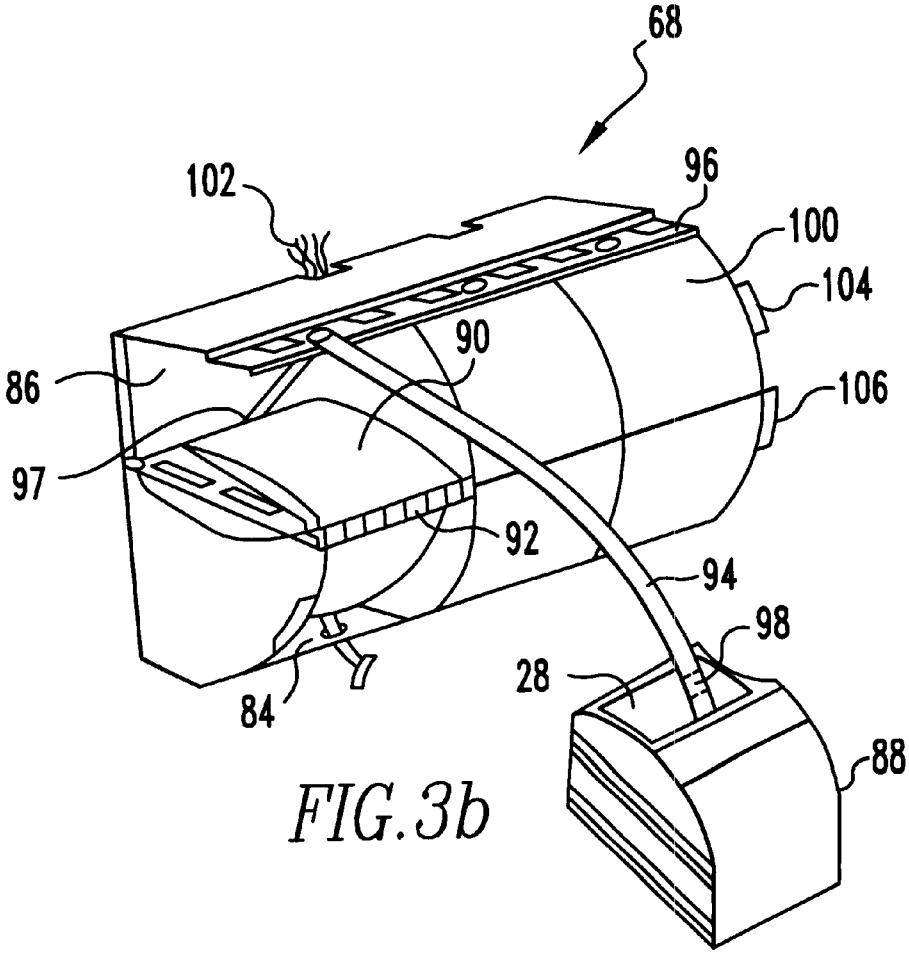
FIG. 3*b* is a perspective view of a payload module for deploying the sonar buoy shown in FIG. 1.

FIG. 3*b* details payload module 68 just after sonar buoy ejection. Payload module 68 has six chambers 84 and 86. Each chamber houses a single sonar buoy as at sonar buoy 88. Each of these sonar buoys is ejected by activation of conventional explosive bolts in the same way as the Tomahawk cruise missile UGM-109D 66 operates to deploy sub-munitions. As the sonar buoy is being ejected closure door 90 pivots on hinge 92 by being pulled by closure lanyard 94, which is attached to the sonar buoy 88. A closure latch 96 is provided for securing door 90. After door 90 is secured, closure lanyard 94 breaks free from payload module 68 at its upper end 97, and breaks free from sonar buoy 88 at weak point 98 and falls into the ocean. Once closed and latched, the closure door 90 fairs the missile airframe for the rest of the flight. The other doors, as at closure door 100, operate in the same manner as closure door 90. Payload module 68 also has an ejector control line 102, which serially activates the ejection of each of the sonar buoys as at sonar buoy 90. As is conventional, payload module 68 also has mounting lugs as at mounting lugs 104 and 106. There is a tear-through cover 108 on the sonar buoy, which is used in the way described hereafter. Module operation during and after ejection is similar to the prior art Tomahawk cruise missile UGM-109D 66 with the exception of ejecting one pack at a time instead of six.

Figure 4:
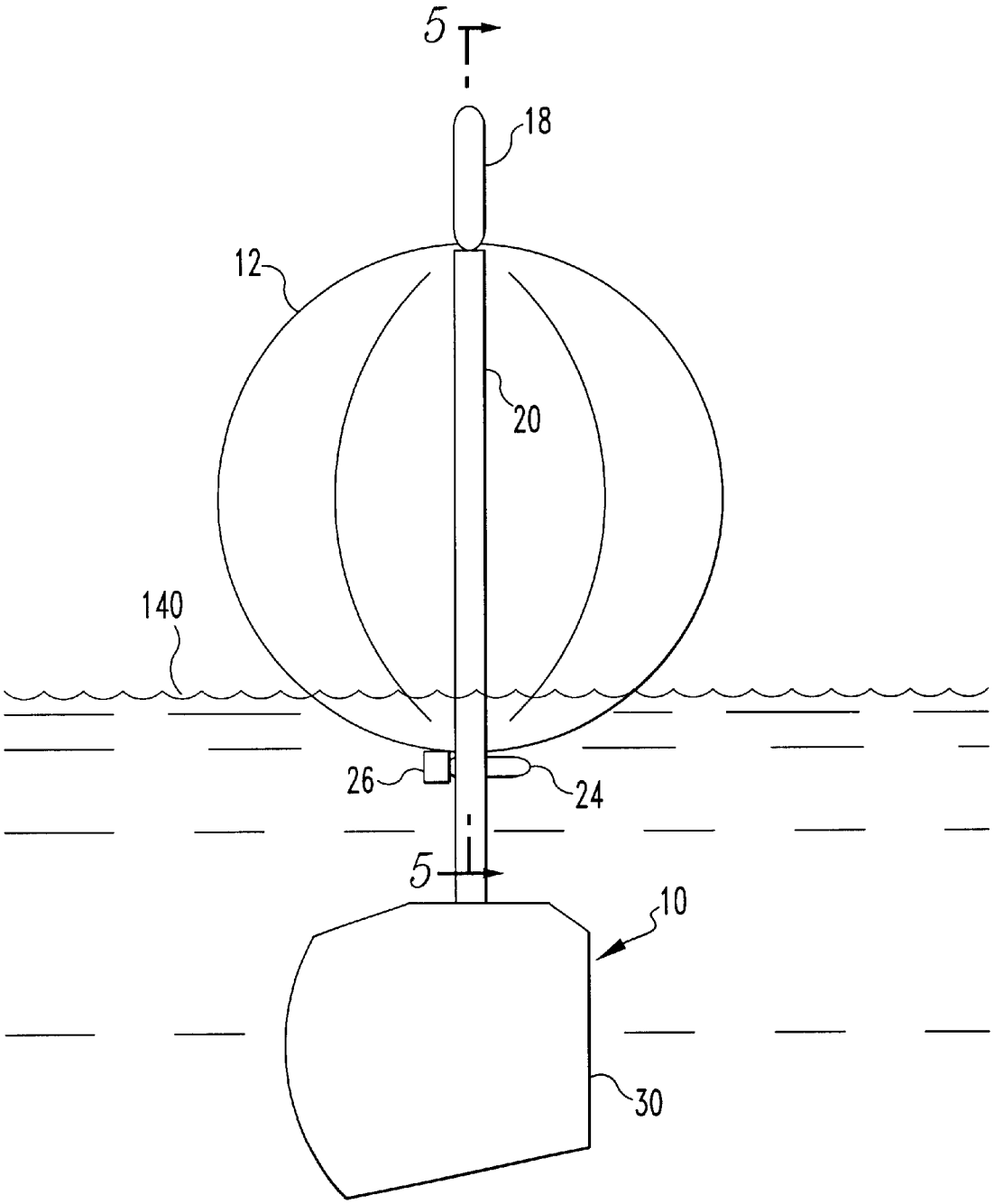
FIG. 4 is a front elevational view of the sonar buoy shown in FIG. 1 after deployment and activation of its flotation device.
Figure 5:
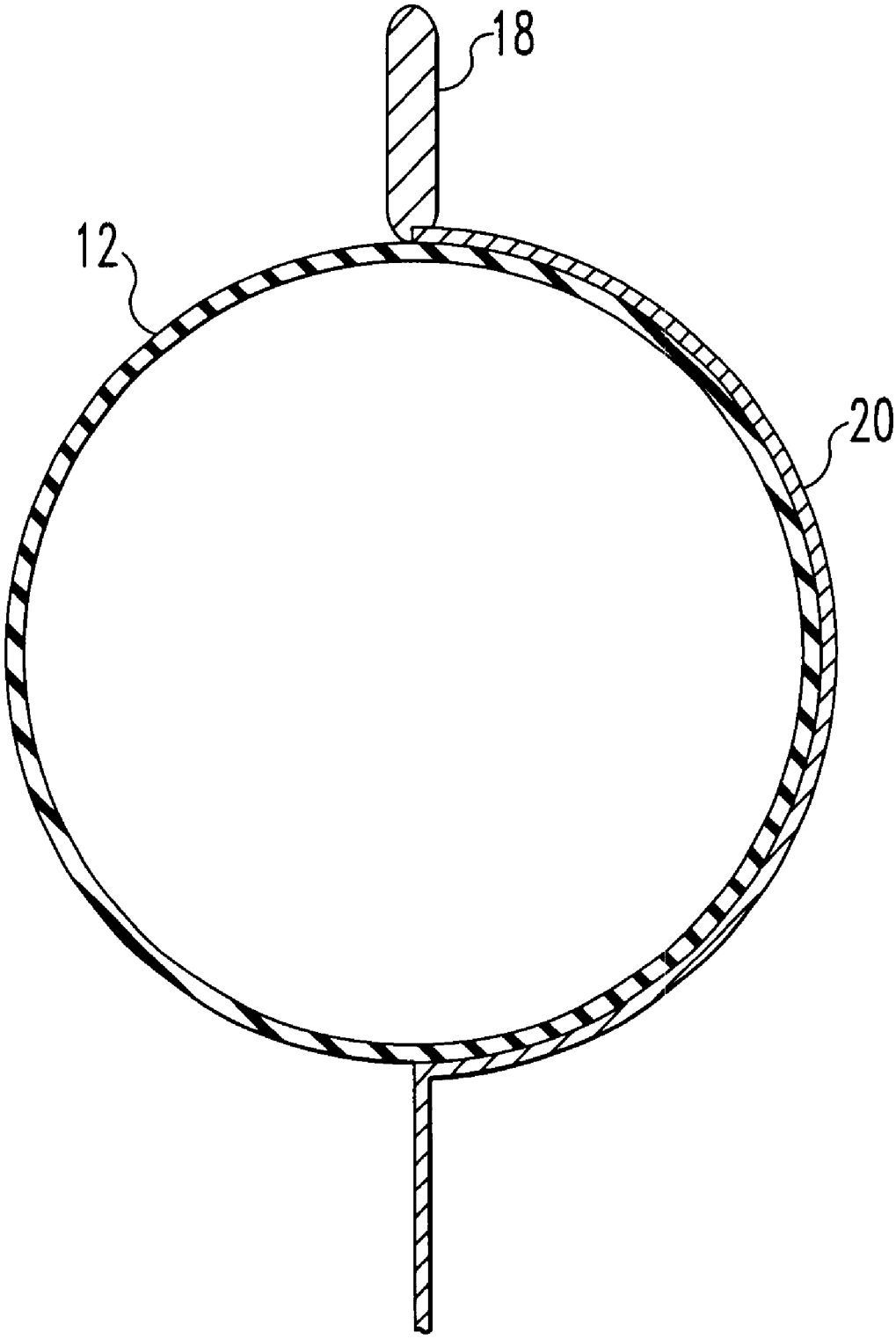
FIG. 5 is a cross sectional view through 5—5 in FIG. 4.
Figure 6:
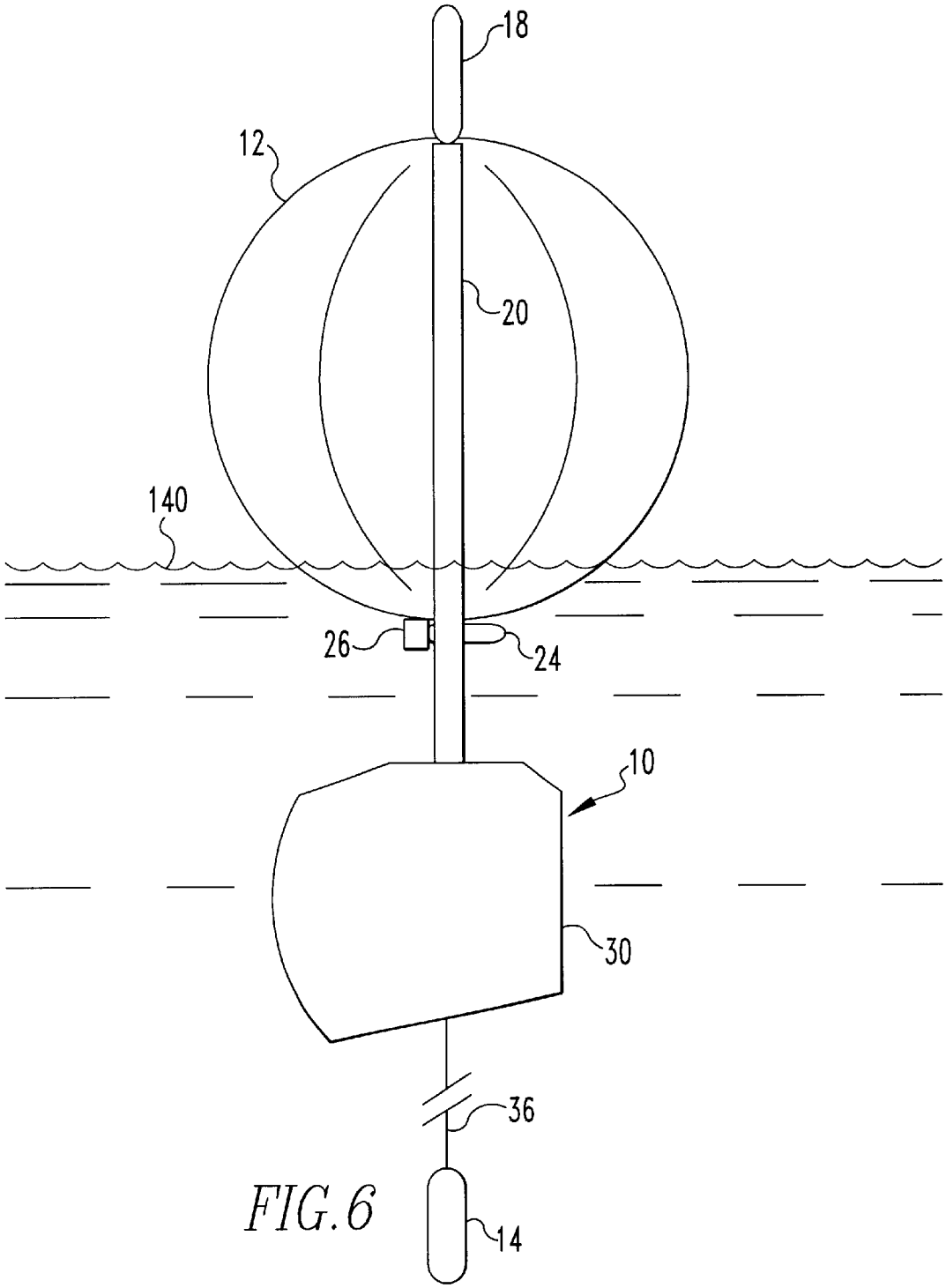
FIG. 6 is a view similar to FIG. 4 after the hydrophone has been deployed.

Referring to FIGS. 1 and 4–6, once fully inflated by the $CO_2$ canister 24 through valve 26, the inflatable float 12 rides on the ocean's surface 140 with the sonar buoy shell 10 suspended by the lanyard/antenna lead 20 below and the hydrophone well 30 facing down. The hydrophone well 30 floods and equalizes through holes in the hydrophone well cover 38. The antenna 18 formerly stowed flat on top of the inflatable float 12 is attached to the lanyard/antenna lead 20 such that it now stands straight up at the top of the inflatable float 12 as shown in FIGS. 4–6. Referring particularly to FIG. 6, the hydrophone 14 is then deployed downwardly on hydrophone wire 36. After a brief delay to allow float deployment and buoy stabilization, the control unit 48 activates the transceiver 46 and the Global Positioning System (GPS) 44. The control unit 48 then awaits a coded transmitter activation signal from a processing unit on a submarine, surface ship or aircraft. Once activated, the transceiver's 46 transmitter sends three distinct pieces of information to shipboard processing unit: the buoy's position as calculated by the GPS 44, the hydrophone 14 output, and a code distinct to the individual buoy. Using the information provided by the sonar buoys, the processor operator could track and classify hostile contacts in or near the field. Using coded signals, the processor operator could turn each transmitter on and off conserving battery power and controlling the size and shape of the field as the buoys drift. When the power of battery 50 falls below a specified level, or upon request of a coded destruct signal from a shipboard processor unit, the control unit 48 fires the scuttle device 54 destroying the buoy and sinking the hydrophone 14.

For the purposes of this disclosure, a "cruise missile" means a pilotless aircraft that can be launched from a submarine, surface ship, ground vehicle or another aircraft, with a range, which will ordinarily be at least one thousand miles, and which flies at a relatively constant altitude that can ordinarily be as low as sixty meters and which has a guidance system capable of directing it through a substantially non-ballistic flight path.

It will be appreciated that because the sonar buoy of the present invention can be deployed at a standoff distance, friendly forces can track hostile contacts with little risk of attack by hostile forces.

It will also be appreciated that a method is provided for manipulating the cruise missile's waypoints, the attack party could select the size and shape of the initial buoy field.

It will also be appreciated that by turning individual buoys on and off, the processor operator could control the size and shape of the buoy field to compensate for drift.

It will also be appreciated that because the device and method of the present inventions allows advanced tracking of contacts, the attacking craft's time in hostile waters is minimized.

It will also be appreciated that the device and method of the present invention as significant potential to aid in intelligence gathering for the classification of unknown contacts.

It will also be appreciated that the device and method of the present invention allows a single submarine to lay multiple fields, miles apart simultaneously.

It will also be appreciated that the device and method of the present invention facilitates copying and processing of buoy transmissions by other ASW forces for strike coordination and asset allocation.

In an alternate embodiment, a cruise missile outfitted with a repeater could loiter near buoy field, thus extending the sonar buoy's transmission range.

In another alternate embodiment, after delivering of the sonar buoys, a cruise missile outfitted with a radar seeker and Identification Friend or Foe (IFF) unit and using residual fuel as an incendiary could seek out and attack a hostile target of opportunity.

In another alternate embodiment, after delivering the sonar buoys, the cruise missile outfitted with a GPS and using residual fuel as incendiary, could attack a specific land target.

In still another alternate embodiment, the sonar buoys could be outfitted with a trigger device, and using the existing scuttle device could be used as anti-personnel weapons to inflict casualties upon curious and unwary enemy personnel who might attempt to retrieve them.

While the present invention has been described in connection with the preferred embodiments of the various figures, it is to be understood that other similar embodiments may be used or modifications and additions may be made to the described embodiment for performing the same function of the present invention without deviating therefrom. Therefore, the present invention should not be limited to any single embodiment, but rather construed in breadth and scope in accordance with the recitation of the appended claims.

What is claimed is:

1. A sonar bouy deployment system comprising:

a pilotless aircraft having subminition compartments therein:

a sonar buoy positionable in one said submunition compartment of said pilotless aircraft and deployable from said subminition compartment, said sonar buoy comprising:

a flotation means for keeping said sonar buoy afloat while deployed in an aquatic environment;

a hydrophone positionable for collecting information in said aquatic environment;

a communication means joined to said hydrophone and said flotation means for transmitting collected information;

releasable means for attaching said sonar buoy to said pilotless aircraft; and a separable tether joined between said pilotless aircraft and said sonar buoy, said tether separating when being subjected to tension after deployment of said sonar buoy.

2. The device of claim 1 wherein:

said pilotless aircraft has a plurality of compartment covers, each capable of covering an associated one of said submunition compartments; and said separable tether being joined to one said compartment cover whereby said tether acts to close said compartment cover on deployment of said sonar buoy.

3. The device of claim 1 further comprising a rigid shell housing said flotation means, said hydrophone and said communication means prior to deployment from said pilotless aircraft.

4. The device of claim 3 wherein said rigid shell defines:

a float well containing said flotation means; and a hydrophone well containing said hydrophone.

5. The device of claim 4 further comprising a tear-through covering positioned on said rigid shell over said float well, said floatation means tearing through said tear-through covering upon deployment.

6. The device of claim 1 wherein said communication means comprises:

a control unit for controlling components of said sonar buoy, said hydrophone being joined to said control unit for transmitting collected information thereto;

an antenna joined to said floatation means wherein after deployment said antenna is maintained above the surface of aquatic environment;

a transceiver joined to said antenna and said control unit for transmitting information; and a global positioning system joined to said transceiver and said control unit for determining the coordinates of said sonar buoy.

7. The device of claim 1 wherein said flotation means further comprises:

an inflatable float; and a compressed gas means in communication with said inflatable float for inflating said inflatable float upon deployment.

8. The device of claim 7 wherein said communication means comprises an antenna joined to said inflatable float wherein after deployment said antenna is maintained above the surface of said aquatic environment.

9. The device of claim 7 wherein said flotation means further comprises an inflation valve joined between the inflatable float and the compressed gas means for expanding the inflatable float on activation of the inflation valve.

10. The device of claim 9 further comprising:

a control circuit positioned in said shell and joined to said inflation valve; and a sensor joined to said control circuit, said control circuit activating said inflation valve to transmit compressed gas from said compressed gas means to said inflatable float after receipt of a signal from said sensor indicating that said device has entered the aquatic environment.

* * * * *